US005276417A

United States Patent [19]

Blanchard et al.

[11] Patent Number: 5,276,417

[45] Date of Patent: Jan. 4, 1994

[54] CURRENT SWITCHING DEVICE

[75] Inventors: Christian Blanchard, Rueil Malmaison; Michel Lauraire, Courbevoie; Didler Vigouroux, Jouy-le-Moutier, all of France

[73] Assignee: Telemecanique, Rueil Malmaison, France

[21] Appl. No.: 880,039

[22] Filed: May 8, 1992

[30] Foreign Application Priority Data

May 13, 1991 [FR] France ..... 91 05748

[51] Int. Cl.[5] ..... H01H 67/02

[52] U.S. Cl. ..... 335/132; 335/202

[58] Field of Search ..... 335/131-3; 335/202

[56] References Cited

U.S. PATENT DOCUMENTS 4,800,332 1/1989 Haury et al. ..... 335/132
4,855,698 8/1989 Cohen et al. ..... 335/20
4,973,929 11/1990 Duchemin ..... 335/132

FOREIGN PATENT DOCUMENTS 0237607 9/1987 European Pat. Off. .

*Primary Examiner*—Lincoln Donovan
*Attorney, Agent, or Firm*—Oblon, Spivak, McClelland, Maier & Neustadt

[57] ABSTRACT

A current switching device comprises, in a box, at least one polar current path, disposed between two connecting terminals. The at least one polar current path comprising, in series, a break pole formed by at least one stationary contact and at least one mobile contact, a protective thermal tripping device having a bi-metal strip surrounded by a heater element and a protective magnetic tripping device having a coil wound around a coil form in which a mobile core slides. A wire of the coil being connected by an intermediate conductor to an end of the heater element. A wire of the heater element comprising a lower end which is substantially straight and without curvature, the lower end of the wire of the heater element being soldered to the intermediate conductor. The intermediate conductor being soldered to a substantially straight lower end of the coil wire. The two tripping devices being carried by a support which is slidably removable from the box.

10 Claims, 3 Drawing Sheets

CURRENT SWITCHING DEVICE

BACKGROUND OF THE DISCLOSURE

1. Field of the Invention

The present invention relates to a current switching device, comprising in a box, at least one polar current path, established between two connecting terminals, with, in series, a break pole formed by at least one stationary contact and at least one mobile contact, a protective thermal tripping device consisting of a bimetal strip surrounded by a heater element and a protective magnetic tripping device consisting of a coil wound around a coil form in which a mobile core slides, the wire of the coil being connected by an intermediate conductor to the end of the heater element.

2. Discussion of the Related Art

In certain protective devices such as cut-out switches or relay switches there is a protective thermal and magnetic module providing a protection against overloads. This thermal-magnetic module comprises a bimetal strip thermal tripping device able to control the opening of the contacts via a tripping mechanism, in response to an overload current.

The thermal-magnetic module also comprises an electromagnetic tripping device provided with a mobile core sliding in a coil form through whose coil the polar current passes. The displacement of the core, in response to an overload or an overcurrent, actuates the opening of the contacts.

The two tripping devices (magnetic and thermal) are housed on the same side of the contact bridge as for example in patent EP-0 237 607. However, this arrangement lengthens the conductive connections between the stationary contact and the bimetal strip and between the magnetic tripping device and the connecting terminal.

SUMMARY OF THE INVENTION

An object of the present invention is to provide for a protective thermal and magnetic module arrangement that makes it possible to connect the components easily without the wires being bent and which reduces the length of the electrical connections that extend between the stationary contact and the connecting terminal. This arrangement makes possible the installation of a spark extinction loop between the two tripping devices of the module. The invention makes possible a good holding in position of the tripping devices in relation to the box. The industrialization of the module is facilitated by the arrangement of the parts that make it up and by the accessibility of the solderings that assure the electrical continuity.

The device according to the invention is characterized by the fact that the wire of the heater element exhibits a lower end that is approximately straight and without curvature and soldered to the intermediate conductor which is soldered to an approximately straight end, without curvature, of the coil wire whose other end that is approximately straight and without curvature is soldered to a lug extending parallel to the axis of the coil and being extended by an area carrying the connecting terminal, the two tripping devices being mounted on two conductive areas, one connected to the stationary contact, the other connected to a terminal, and that are carried by a support that can be removed from the box.

According to a characteristic of the present invention, the bimetal strip of the thermal tripping device is attached at its base to an area of the conductor carrying the stationary contact, and having a U shape, enclosing a support of the box so that the stationary contact is arranged under the bimetal strip and so that it is positioned toward the center of the device in relation to the protective magnetic tripping device.

According to a further characteristic of the present invention, the intermediate conductor joining a thermal tripping device to the magnetic tripping device joins the lower end of the heater element to the lower end of the coil wire and has the shape of a loop so as to serve as the spark extinction.

According to another characteristic, the support is a sliding mechanism which is composed of a conductor-carrying plate and two lateral walls making an internal chamber coming out into a channel formed by two partitions of the box, next to the central part, these walls being inserted between these partitions so as to be adjacent to them.

BRIEF DESCRIPTION OF THE DRAWINGS

The invention will now be described in greater detail by referring to an embodiment given by way of example and represented by the accompanying drawings in which.

DESCRIPTION OF THE PREFERRED EMBODIMENTS

Figure 1:
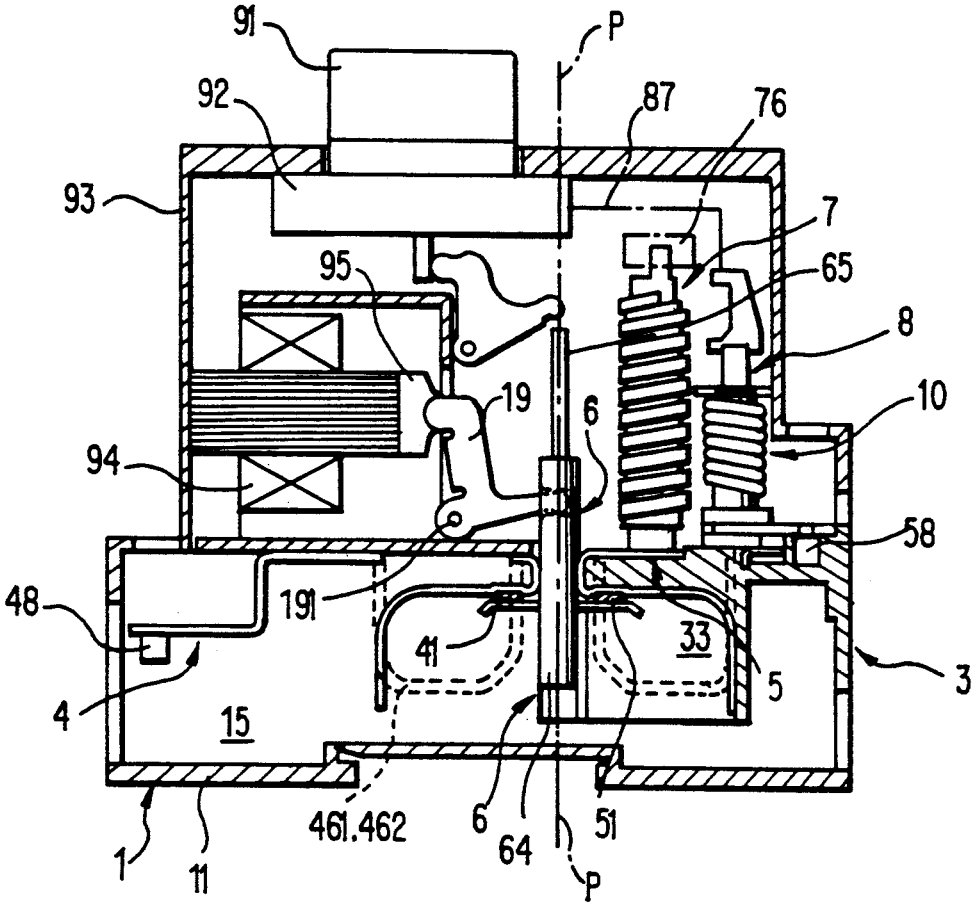
FIG. 1 is a diagrammatic elevation view of a protective device according to the invention.

The switching device illustrated by the drawings is a multipolar protective device of the relay switch type a single pole of which has been shown.

The device comprises a single-piece box 1 associated with a cover 93.

Box 1 and cover 93 are made by molding of electrically insulating material (plastic).

Base 11 for fastening the box is directly integral with insulation partitions 18 (FIG. 2) which constitute, two by two with bottom 11 of the box, a channel 15 delimiting the cut-off chamber of a pole. These partitions 18 extend perpendicular to the bottom or flat base 11 and parallel to one another.

Channel 15 cooperates with support-sliding mechanism 3 which, on the one hand, delimits cut-off chamber 33 with the box and which, on the other hand, carries a magnetic and thermal tripping module 10.

The pole of the device which is represented is of the double cut-off type. It comprises two stationary contacts 41 and 51 placed on two conductors 4 and 5 connecting them respectively to connecting terminals 48 or 58 intended to be connected to a power line. A bridge 63 of mobile contacts 61 and 62 cooperates with the stationary contacts to interrupt the current between the terminals. These mobile contacts 61 and 62 are displaced in translation in relation to stationary contacts 41 and 51, perpendicular to a line passing through these stationary contacts. The plane of displacement and of symmetry of mobile contacts 61 and 62 is marked PP'. In closed position, the mobile contacts are flattened against the stationary contacts. In open position, the mobile contacts are separated from the stationary contacts as a result of an automatic tripping—in case of overload or overcurrent—or of a manual control.

Mobile bridge 63 carrying mobile contacts 61 and 62 is mounted on a contact-carrying module 6. Bridge 63 is displaced between the stationary contacts and bottom 11 of the box.

Contact-carrying module 6 comprises a support module 64 in which the contact bridges 63 of the different poles and of the associated operating slides 65 are mounted. Each contact bridge 63 is housed to slide in a window of support 64. A compression spring of the contacts draws each associated bridge 63 upward in the direction of closing of the contacts. By way of information, the spring is housed in the window. Each of bridges 63 can be displaced in the direction of opening of the contacts by the associated slide 65. This module 6 comprises as many slides as there are poles.

Module 6 is introduced, along plane PP', into a housing of the box. Support 64 exhibits slots into which the partitions of the box enter. Mobile support 64 can slide, along plane PP', relative to the box, by being guided against the partitions of the box.

Bridges 63 of module 6 can be displaced as a result of a fault detected by the magnetic and thermal tripping unit 10 and this after tripping of a lock 92 which will be discussed below. Bridges 63 of module 6 can also be displaced by electrodynamic repulsion or by a control button such as 91 which acts on the lock and the electromagnet.

The plates of stationary contacts 41 and 51 are placed on conductors 4 and 5, on the side of bottom 11 of the box. Stationary contacts 41 and 51 are positioned toward the central part of the device while connecting terminals 48 or 58 are positioned on the sides of the box.

Conductor 4 directly connects stationary contact 41 to terminal 48.

Stationary contact 51 is connected in series to terminal 58 via conductor 5, a bimetal strip thermal tripping device, designated overall as 7, for protection against overload currents and an electromagnetic tripping device, designated overall as 8, for protection against short-circuit currents.

Tripping devices 7 and 8, conductor 5 and stationary contact 51, terminal 58 and the intermediate connections are part of the same single-piece subassembly designated by the general reference number 10.

Figure 3:
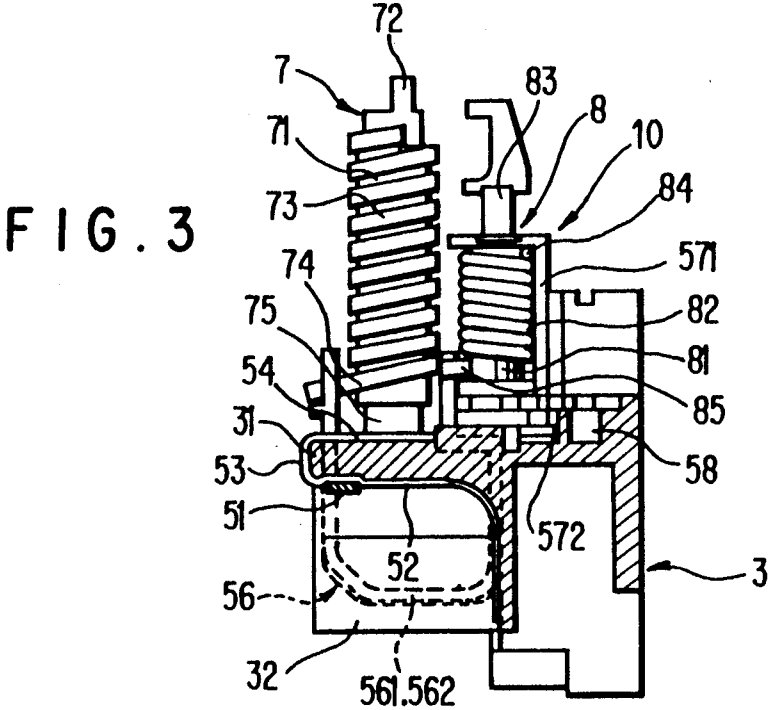
FIG. 3 is associated with a pole of the device of FIGS. 1 and 2.
Figure 4:
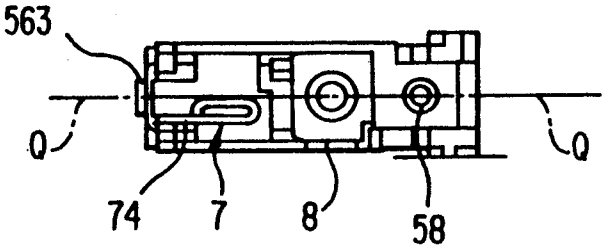
FIG. 4 is a top view of FIG. 3.

Magnetic and thermal tripping module 10 is represented in detail in FIGS. 3 and 4. This module 10 is placed on the side opposite electromagnet 94 relative to plane PP'. Bimetal strip tripping device 7 is positioned between protective magnetic tripping device 8 and translation plane PP' of the bridge 63 of mobile contacts. The axes of the bimetal strip and of tripping device 8 are parallel to PP,.

Module 10 comprises a sliding mechanism 3 of electrically insulating material (plastic) which carries tripping devices 7 and 8.

Sliding mechanism 3 exhibits an upper plate 31 connected to two lateral walls 32. These walls make in each sliding mechanism an internal chamber 33 forming a cut-off chamber.

Internal chamber 33 of sliding mechanism 3 come out in associated channel 15, next to the central part marked by plane PP'.

The two lateral walls 32 and adjoining upper plate 31 have a cross section (parallel to PP') in the shape of a U. Walls 32 of the sliding mechanism are inserted between two neighboring partitions 18 of the box so as to be adjacent to them. Because of the U-shaped cross section of sliding mechanism 3, internal chamber 33 made in the latter comes out in the bottom of the corresponding channel.

Tripping devices 7 and 8 are housed between two partitions 18 of the box.

Thermal tripping device 7 associated with each pole comprises a flat bimetal strip 71 extending in a plane parallel to the plane marked QQ' (FIG. 4) parallel to partitions 18 and perpendicular to plane PP'. By its base 75, it is fastened integrally to area 54 of conductor 5 carrying stationary contact 51. Wound around the bimetal strip is a heater element 73 that is insulated from the bimetal strip. This heater element is connected electrically by its upper end to free end 72 of the bimetal strip. Free ends 72 of the tripping devices are able, by locking mechanism 92, to actuate slides 65 of module 6.

The plane of bimetal strip 71 is approximately parallel to partitions 18.

Electromagnetic tripping device 8 of each pole comprises a coil form 81 around which a control coil 82 is wound. It also comprises a mobile core 83 sliding inside coil form 81. A return spring is mounted between the core and the coil form. Mobile coil 83 is extended axially outside of the coil form and acts on mechanism 92 that itself acts on slides 65 of module 6.

Conductor 5 exhibits a part or blade 52, located under the plate of sliding mechanism 3, which carries stationary contact 51 and is extended by a lateral portion 53 and by an area 54 folded over on the top of sliding mechanism 3. This area 54 is integral with base 75 of bimetal strip 71.

Lower end 74, approximately straight and without curvature, of heater element 73 extends parallel to the plane of the bimetal strip, toward plane PP'. This end 74 is connected, by an intermediate conductor 56 in the shape of a loop, to lower end 85 of coil wire 82.

Upper end 84 of the coil wire is soldered to a conductive part 57 made of ferromagnetic material and consisting of a lug 571 and an area 572 carrying terminal 58 and magnetic tripping device 8. Lug 571 extends parallel to the axis of the coil and is extended by area 572 carrying terminal 58. Lower end 85, approximately straight and without curvature, of the coil wire extends parallel to the plane of the bimetal strip while upper end 84, approximately straight and without curvature, extends perpendicular to this plane. Upper end 84 of the coil wire is soldered at any height of lug 571 depending on the natural exit point of this end after coiling.

Areas 54 and 572 are flattened against the top of sliding mechanism 3 while blade 52 is flattened under this sliding mechanism 3.

Part 57 exhibits a bent part 573 that is housed in coil form 81 so as to constitute the stationary core. Lug 571 of ferromagnetic material also participates in the circulation of the flux created by the coil.

Intermediate conductor 56 in the shape of a loop exhibits a central clip 563 that extends above the sliding mechanism and soldered to end 74 of the heater element. This central clip 563 is connected to two lateral loops 561 and 562 that extend vertically against the sides of sliding mechanism 3. The two lateral loops 561 and 562 are joined to a lateral clip 564 that extends above the sliding mechanism and below coil form 81.

Clip 564 is extended by a small bar 565 to which lower end 85 of the coil wire is soldered.

Mobile core 83 is extended by a coupling element 86 connected by a return mechanism 87 to lock 92.

The lateral edges of area 54 are engaged in guide mechanisms 182 made on partitions 18 of the box. The lateral edges of area 572 are engaged in guide mechanisms 183 made on partitions 18.

Area 572 is engaged in a groove 811 of coil form 81 so that the latter is immobilized in translation.

The device also comprises a locking tripping mechanism common to all the poles and housed in a compartment of the box. Mechanism 92 is connected to a resetting and manual control button 91 which is used for resetting, closing and opening the contacts.

An electromagnet 94 for driving the contacts that is housed in box 1 acts on module 6. This electromagnet, in a way known in the art, comprises a fixed magnetic circuit, a mobile armature 95 and a coil connected to terminals by a switch. This latter can be controlled in a way known in the art. Mobile armature 95 of the electromagnet is secured to a return spring and acts by button 91 and/or by another control.

Mobile armature 95 of the electromagnet acts on a mobile rocking lever 19, hinged around a pin 191 on the box and actuating mobile support 64 of module 6. This rocking lever makes possible the displacement of support 64 to operate the contacts.

So-called "deionization" plates can be placed near the contacts to facilitate the rapid interruption of the current. These plates can be mounted on the sliding mechanisms or on the box.

The operation of the device will now be described.

Thermal tripping device 7 acts on a differential system 76 which, by locking mechanism 92, actuates the mobile contacts.

Magnetic-thermal tripping device 8, by return mechanism 87 and locking mechanism 92, acts on the mobile contacts.

We claim:

1. A current switching device comprising:

a box having at least one polar current path between two connecting terminals therein, the at least one current polar path having, in series, a break pole formed by at least one stationary contact and at least one mobile contact, a protective thermal tripping device comprises of a bimetal strip surrounded by a heater element, and a protective magnetic tripping device comprised of a coil wound around a coil form in which a mobile core slides, a wire of the coil being connected by an intermediate conductor to an end of the heater element;

wherein:

a wire of the heater element comprises a lower end which is substantially straight and without curvature, the lower end of the wire of the heater element being soldered to one end of the intermediate conductor, the other end of the intermediate conductor being soldered to a substantially straight lower end of the coil wire, said straight lower end of the coil wire having no curvature, said coil wire having a further end which is substantially straight and without curvature, said further end of the coil wire being soldered to a lug which extends parallel to an axis of the coil, said lug being extended by a first conductive area which carries and is connected to one of said two connecting terminals;

the magnetic tripping device is mounted on said first conductive area which is connected to said one connecting terminal;

the protective thermal tripping device is mounted on a second conductive area which is connected to said at least one stationary contact; and the two tripping devices and the respective first and second conductive areas on which the two tripping devices are mounted are carried by a support which is movable from said box.

2. The device according to claim 1, wherein the bimetal strip of the thermal tripping device is attached at its base to the second conductive area of the conductor which carries the stationary contact, the conductor having a U shape, for enclosing the support of the box so that the stationary contact is arranged under the bimetal strip and so that the stationary contact is positioned toward the center of the device in relation to the protective magnetic tripping device.

3. The device according to one of claims 1 or 2, wherein the intermediate conductor which joins the thermal tripping device to the magnetic tripping device joins the lower end of the heater element to the lower end of the coil wire and has a loop shape for serving as a spark extinction.

4. The device according to claim 3, wherein the box comprises two partitions, and the support is a sliding mechanism comprising a conductor-carrying plate and two lateral walls which define an internal chamber which comes out into a channel formed by the two partitions of the box, next to a central part of the box, the walls being inserted between the two partitions so as to be adjacent to the two partitions.

5. The device according to claim 4, wherein a plane of the bimetal strip is perpendicular to a plane of symmetry and translation of the mobile contacts, the break pole having a double interruption.

6. The device according to claim 5, wherein the conductor which joins the thermal tripping device to the magnetic tripping device comprises two spark extinction loops which are each flattened against a lateral face of the support and face a partition of the box, the spark extension loops being joined on a blade part of the conductor which carries the stationary contact and being positioned in the internal chamber defined by the support for forming a cut-off chamber.

7. The device according to claim 6, wherein the lug soldered to the coil wire and the first conductive area are part of a conductive part which comprises a part which is housed in the coil form for defining a stationary core.

8. The device according to claim 7, wherein the partitions of the box comprise guide mechanisms for centering and positioning each of the tripping devices.

9. The device according to claim 8, wherein the spark extinction loops are isolated between the support and partitions of the box.

10. The device according to claim 9, wherein the conductive part, the lug soldered to the coil wire, and the first conductive area which supports the magnetic tripping device are made of ferromagnetic material.

* * * * *

UNITED STATES PATENT AND TRADEMARK OFFICE

CERTIFICATE OF CORRECTION

PATENT NO. : 5,276,417

DATED : January 4, 1994

INVENTOR(S) : CHRISTIAN BLANCHARD ET AL

It is certified that error appears in the above-indentified patent and that said Letters Patent is hereby corrected as shown below:

In the figure on the title page, on the line PP, change the lower "P" to --P'--.

In Figure 1, on the line PP, change the lower "P" to --P'--.

Figures 2A, 2B:
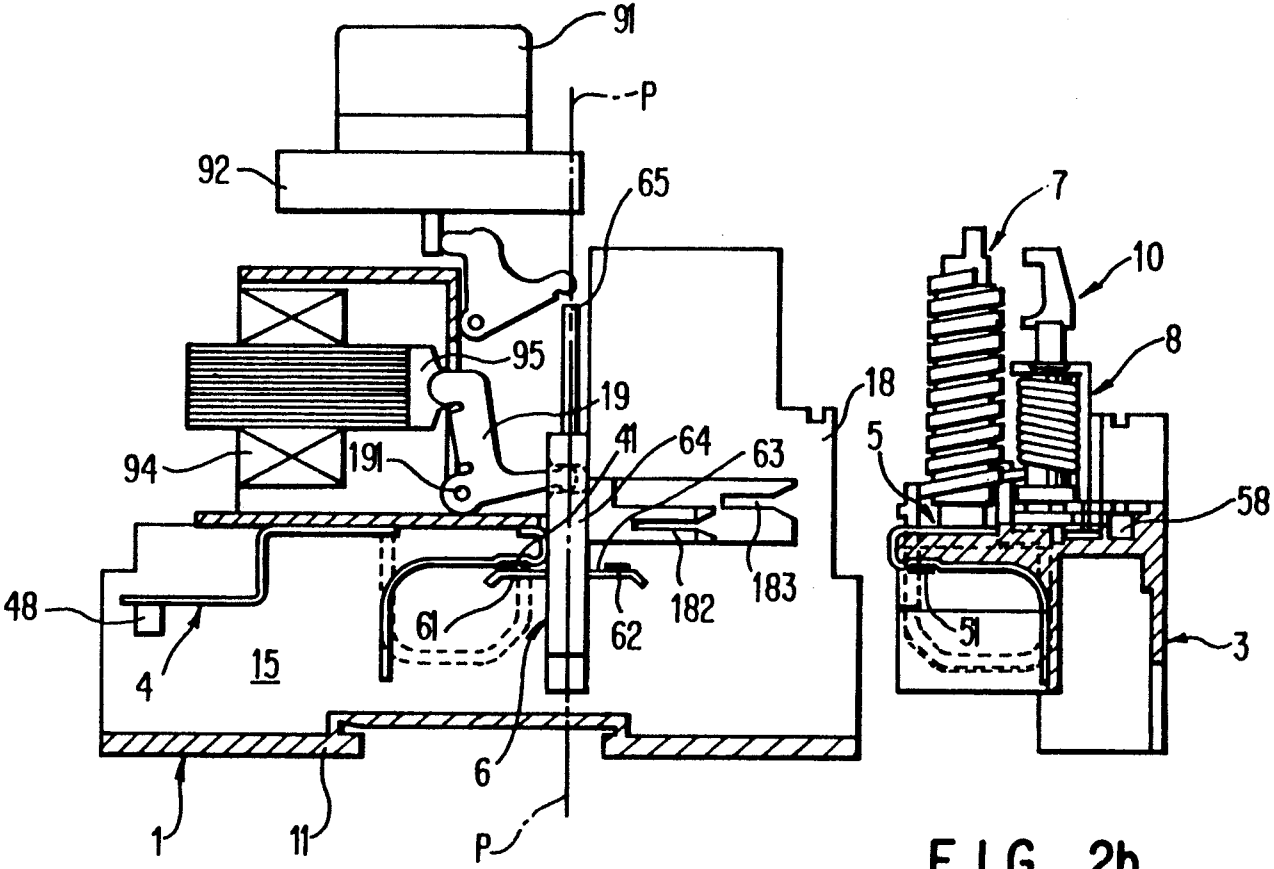
FIG. 2A is a diagrammic elevation view of the device of FIG. 1.
FIG. 2B is a diagrammic elevation view of the magnetic-thermal module.
Figure 5:
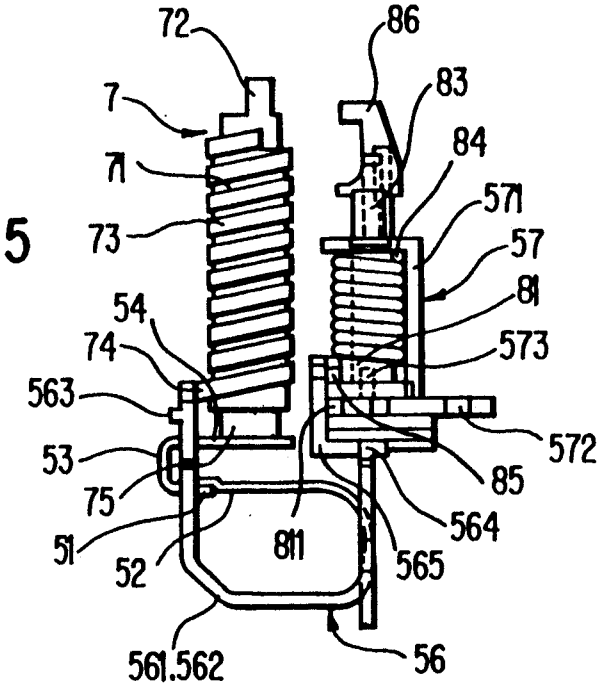
FIG. 5 is an elevation view of the magnetic and thermal tripping devices represented separated from their support of the box.
Figure 6:
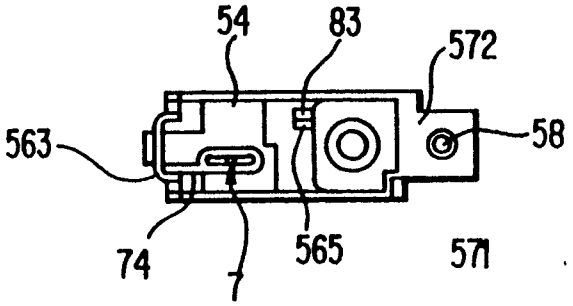
FIG. 6 is a top view of FIG. 5.

In Figure 2a, on the line PP, change the lower "P" to --P'--.

In Figure 4, on the line QQ, change the "Q" on the right-hand side to --Q'--.

In column 2, line 32, after "3 is" insert --a detail view of the magnetic-thermal module--.

In column 3, line 60, change "PP," to --PP'--.

Signed and Sealed this

Twenty-eight Day of February, 1995

*Attest:*

BRUCE LEHMAN

*Attesting Officer*

*Commissioner of Patents and Trademarks*